US008118455B2

(12) United States Patent
Cowan et al.

(10) Patent No.: US 8,118,455 B2
(45) Date of Patent: Feb. 21, 2012

(54) LIGHTING FIXTURE WITH RESILIENT CLIP MOUNTING ELEMENT

(75) Inventors: David M. Cowan, Cornwall Bridge, CT (US); Petar Miskovic, New York, NY (US)

(73) Assignee: Lightning Services Inc., Stony Point, NY (US)

( * ) Notice: Subject to any disclaimer, the term of this patent is extended or adjusted under 35 U.S.C. 154(b) by 269 days.

(21) Appl. No.: 12/610,847

(22) Filed: Nov. 2, 2009

(65) Prior Publication Data

US 2011/0103065 A1 May 5, 2011

(51) Int. Cl.
*F21V 21/088* (2006.01)
*F21V 17/16* (2006.01)

(52) U.S. Cl. ..... 362/306; 362/311.14; 362/341; 362/396; 362/444; 362/455

(58) Field of Classification Search ..... 362/296.01, 362/300, 306, 310, 311.01, 311.14, 341, 362/370, 374, 396, 440, 444, 449, 455
See application file for complete search history.

(56) References Cited

U.S. PATENT DOCUMENTS

| | | | | | |
|---|---|---|---|---|---|
| 126,577 | A | * | 5/1872 | Robinson | 362/374 |
| 1,054,747 | A | * | 3/1913 | Christian | 362/374 |
| 1,466,944 | A | * | 9/1923 | Baughn | 362/374 |
| 1,505,577 | A | * | 8/1924 | Allen | 362/374 |
| 1,546,087 | A | * | 7/1925 | Kuen | 362/374 |
| 1,626,593 | A | * | 5/1927 | Bamford | 362/374 |
| 1,690,016 | A | * | 10/1928 | Jording | 362/374 |
| 2,647,984 | A | * | 8/1953 | Falge | 362/374 |
| 2,960,361 | A | * | 11/1960 | Boutelle | 362/374 |
| 3,069,541 | A | * | 12/1962 | Thomsen et al. | 362/374 |
| 6,079,992 | A | | 6/2000 | Kuchar et al. | |
| 6,942,368 | B1 | | 9/2005 | Kane et al. | |

* cited by examiner

*Primary Examiner* — Ismael Negron
(74) *Attorney, Agent, or Firm* — St. Onge Steward Johnston & Reens LLC

(57) ABSTRACT

A specialized lighting fixture including a main housing and a front bezel, and a pair of clip elements mounted in the bezel to removably secure one or more filters and a reflector. The clip elements also include a pair of opposed spring arms angled towards the bezel axis with the upper portion of the side edges of the arms positioned closer to the bezel axis than the lower portion of such edges. The bezel includes support surfaces that function, together with the clip elements to position the reflector with respect to the bezel and the bezel with respect to the main housing.

17 Claims, 6 Drawing Sheets

LIGHTING FIXTURE WITH RESILIENT CLIP MOUNTING ELEMENT

FIELD OF THE INVENTION

The invention relates to lighting fixtures, particularly of the type used for commercial and theatrical lighting requirements.

BACKGROUND OF THE INVENTION

Specialized lighting fixtures, for commercial and theatrical lighting, for example, frequently utilize various forms of accessories, such as filters, conditioners and lenses to modify the shape, color or other aspects of the emitted lighting. These accessories may be changed from time to time to achieve different lighting effects, and a number of arrangements have been proposed heretofore to accommodate such periodic changes. The fixture of the Kane et al U.S. Pat. No. 6,942,368, for example, utilizes a removable cartridge in which accessory elements are installed in advance of the cartridge itself being placed in the fixture. One of its important advantages is that the accessory group may be pre-assembled at ground level, which facilitates and makes safer the final installation, which frequently must take place on a high ladder. Many other proposals can, however, be overly complicated and expensive and/or can be more cumbersome and time consuming than is desired.

SUMMARY OF THE INVENTION

The present invention is directed to a novel and improved form of specialized light fixture having a uniquely simplified and economical facility for the removable mounting of accessory elements as well as for mounting of a reflector element. The invention makes use of novel, multifunctional accessory retaining elements which are mounted in the bezel, at the front of the lamp housing, and enable one or several accessory elements to be carried in the bezel and to be easily installed in and removed therefrom. The bezel and the multifunctional retaining elements also include novel features for removably retaining and accurately positioning the reflector of the lamp to maximize the efficiency of the lighting output and to facilitate installation and replacement of the reflector and/or lamp as necessary or desirable. Additionally, the design of the lamp components is such that portions of the multifunctional elements are engageable with portions of the lamp housing to enable the bezel to be easily and expeditiously joined with and locked to the lamp housing after installing or changing accessories or changing of the lamp, for example. The fixture of the invention, while having significant functional advantages is also very economical to manufacture because primary components, i.e., housing and bezel, may be plastic moldings, while the inexpensive and easily installed multifunctional elements enable bezel to be securely and accurately attached to the housing with a small rotation of the bezel, while providing for mounting of the reflector and various accessories in an precise and reliable manner.

For a more complete understanding of the above and other features and advantages of the invention, reference should be made to the following detailed description of a preferred embodiment of the invention and to the accompanying drawings illustrating the invention.

DETAILED DESCRIPTION OF THE INVENTION

Figure 1:
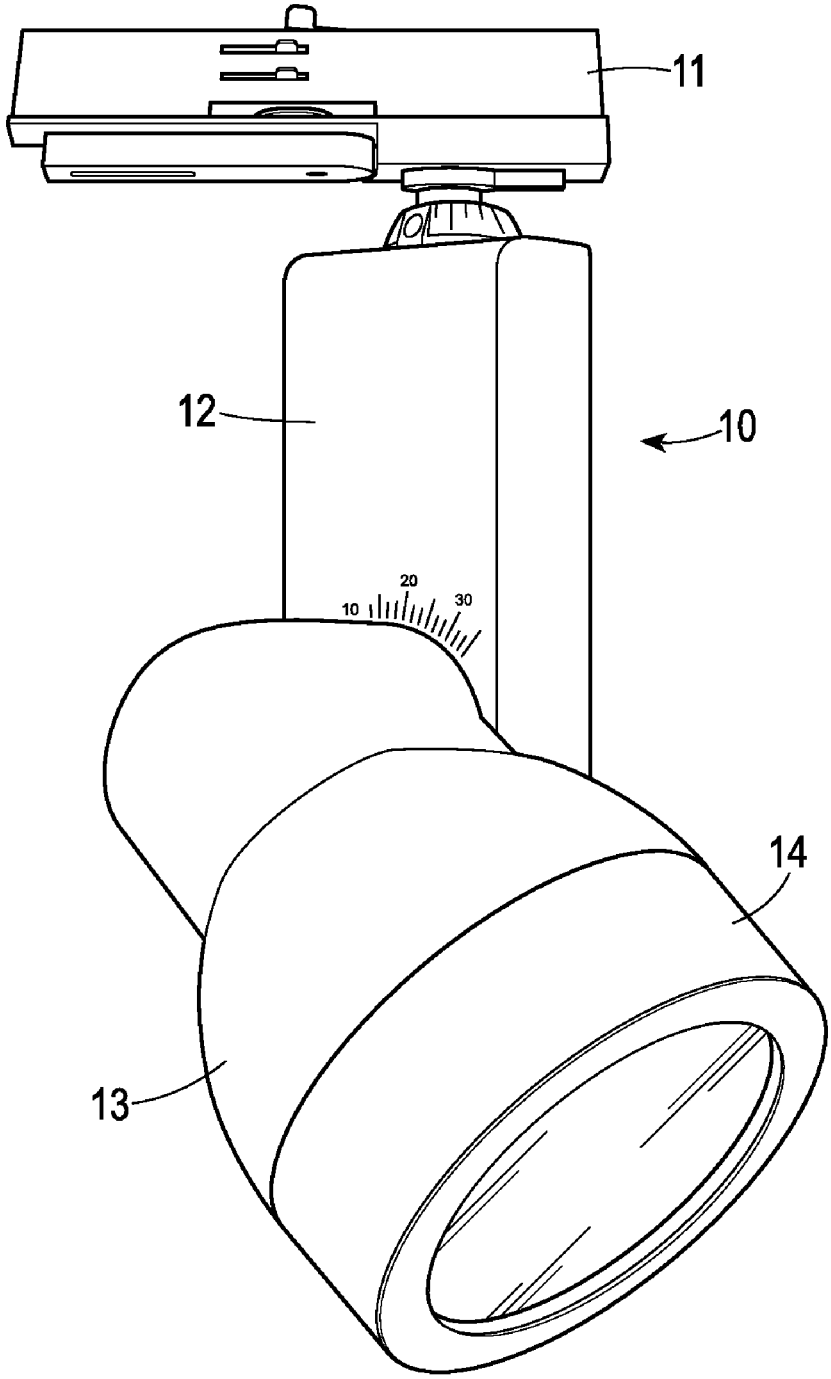
FIG. 1 is a perspective view of a typical form of lighting fixture incorporating the invention.

Referring now to the drawings, the numeral 10 designates generally a light fixture incorporating the invention. The illustrated fixture is shown as a track lighting fixture, for mounting in a suitable bus bar (not shown). However, the invention is directed to features of the lamp itself without regard to the manner of its mounting. The illustrated embodiment includes a track mounting body 11, a transformer housing 12 extending downward from the mounting body and rotatable with respect thereto, a lamp housing 13 rotatably mounted on the transformer housing, and a bezel 14 secured to the front of the lamp housing.

Figure 2:
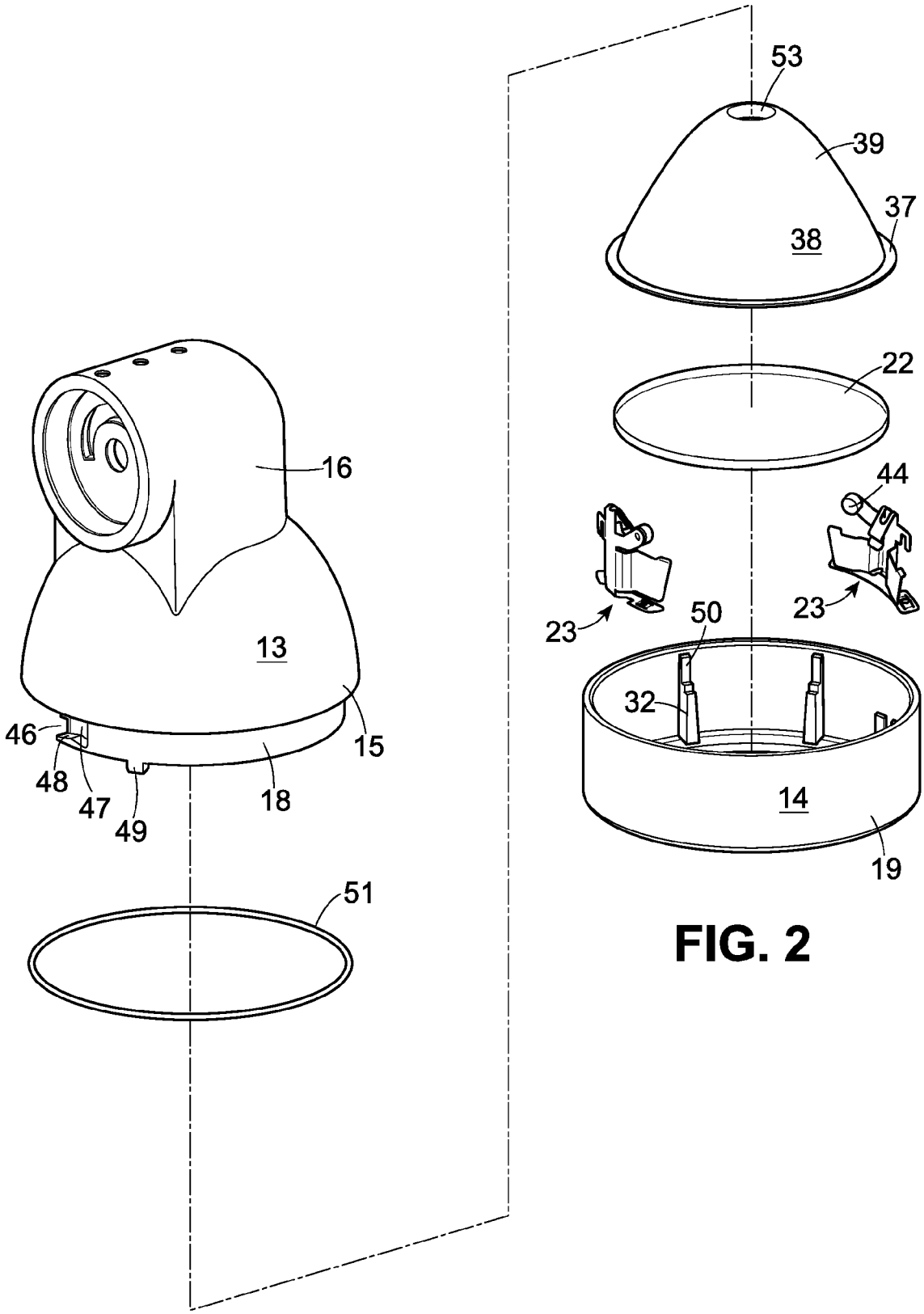
FIG. 2 is an exploded view of a portion of the fixture of FIG. 1 illustrating certain features of the invention.
Figure 7:
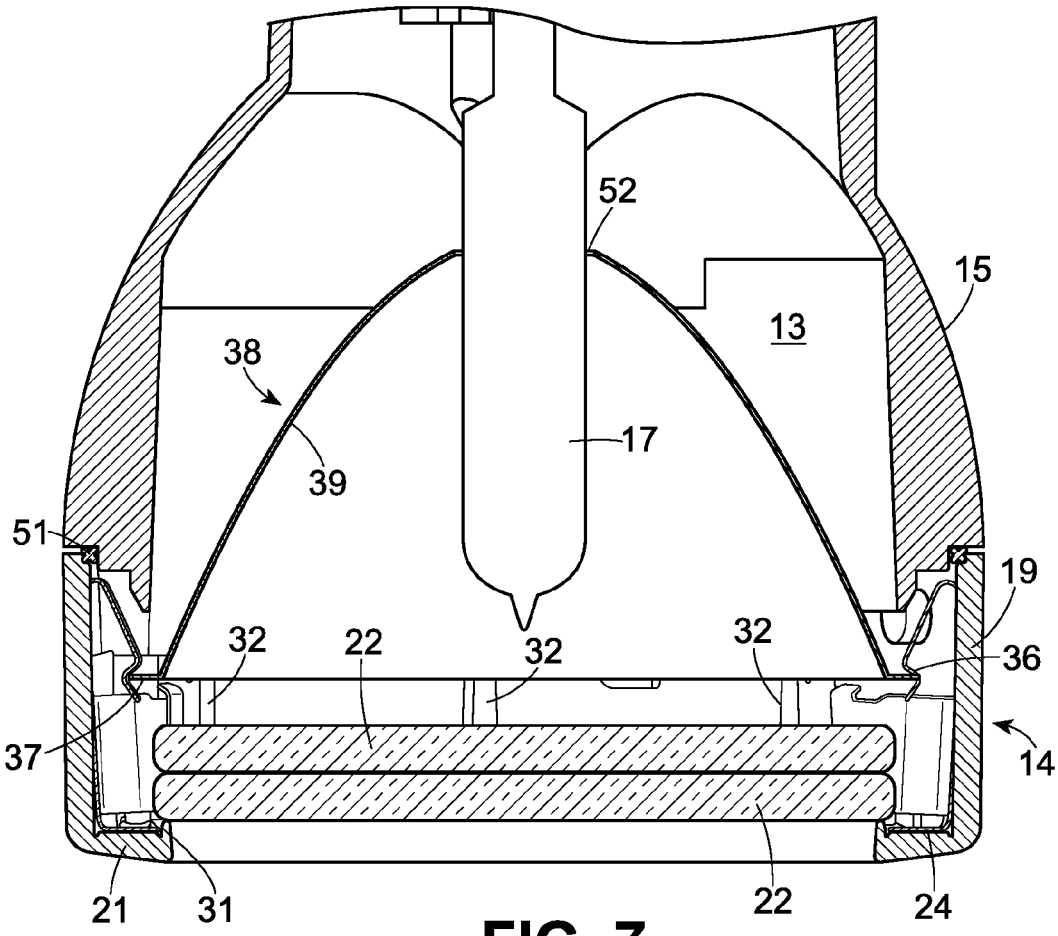
FIG. 7 is a diametric cross sectional view through the lamp housing and bezel of FIG. 1.

With reference to FIGS. 2 and 7, the lamp housing 13 comprises a lower portion 15 of circular cross section joined with an upper portion 16 which mounts to the transformer housing 12. The upper portion of the lamp housing includes means of a standardized form (not shown) for mounting a lamp 17. In the preferred form of the invention, the lamp 17 is a metal halide type, having an elongated cylindrical bulb form, which is mounted in the housing to be substantially coaxial with the circular portion 15 of the housing 13. A suitable lamp for this purpose is a GE CMH14/T/U/830/G12 which is available commercially from the General Electric Company.

The lower portion of the lamp housing 13 is formed with a downwardly projecting cylindrical wall 18 of smaller diameter than adjacent portions of the housing 15, which is adapted to be closely received within the cylindrical side wall 19 of the bezel 14. The bezel 14 also is formed with an inwardly projecting annular bottom flange 21 which defines a front opening and provides support for one or more circular lenses or circular filter discs 22 in a manner to be described. It should be understood in connection with this description that directional references, such as vertical, horizontal, upper, lower, etc. are used for convenience only, and with respect to the invention in its specifically illustrated orientation.

In accordance with one aspect of the invention, the bezel 14 mounts internally a pair of diametrically opposed, multifunctional accessory retaining elements 23, shown in detail in FIGS. 3-6. The accessory retaining elements 23 advantageously are stamped from a single section of spring metal, for example stainless steel of a thickness of about 0.015 inch. Each accessory retaining element 23 includes a flat base member 24 of arcuate shape, arranged to be supported on the bottom flange 21 of the bezel 14 and to be secured thereon by friction clips 25 which are engageable with posts (not shown) projecting upward from the flange 21. A vertical support 26 extends upward from the base member 24 to a level near but not above the upper edge of the cylindrical bezel flange 21, as shown in FIG. 7.

On each side of the vertical support 26 there are formed inwardly projecting panels 27 which, among other things, impart stiffness to lower portions of the vertical support 26. Spring arms 28 extend divergently inward from inner edges of the panels 27 and are disposed relative to each other at a relatively shallow angle of, in the illustrated embodiment, about 128 degrees. For a bezel of about four inches in diameter, an advantageous form of multifunctional accessory retaining element 23 may have a "wing span", between upper corner areas 29 of the spring arms 28, of about 1.46 inches.

Figure 3:
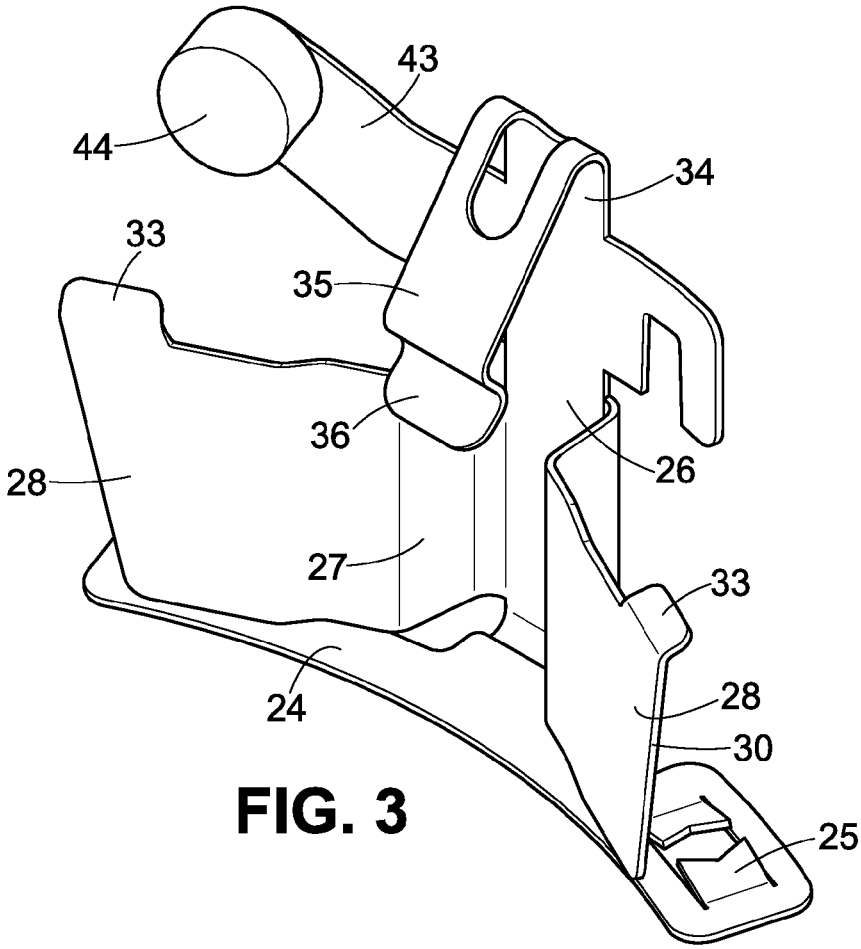
FIG. 3 is an enlarged perspective view of a novel form of multifunctional element incorporated in the fixture of FIG. 1 and serving in multiple capacities therein as will be described.
Figure 4:
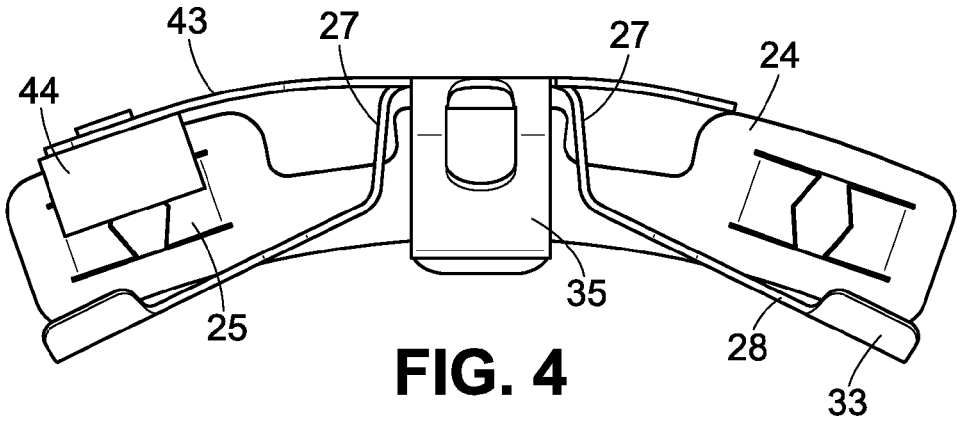
FIG. 4 is a top plan view of the multifunctional element of FIG. 3.
Figure 5:
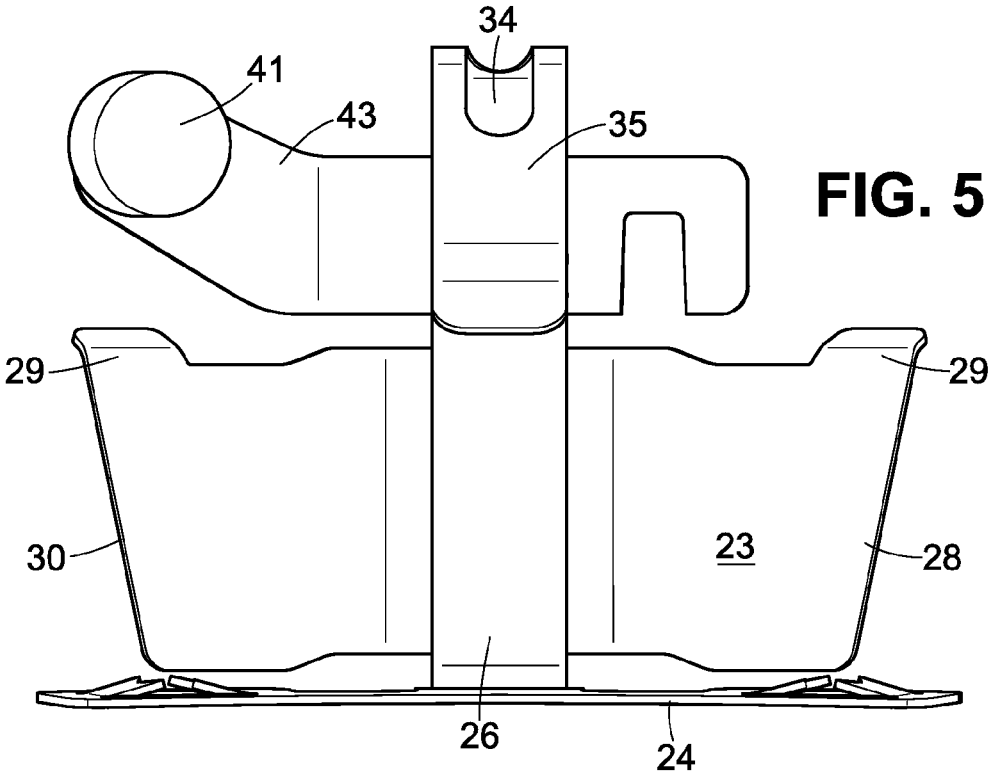
FIGS. 5 and 6 are front and side elevational views respectively of the element of FIG. 3
Figure 6:
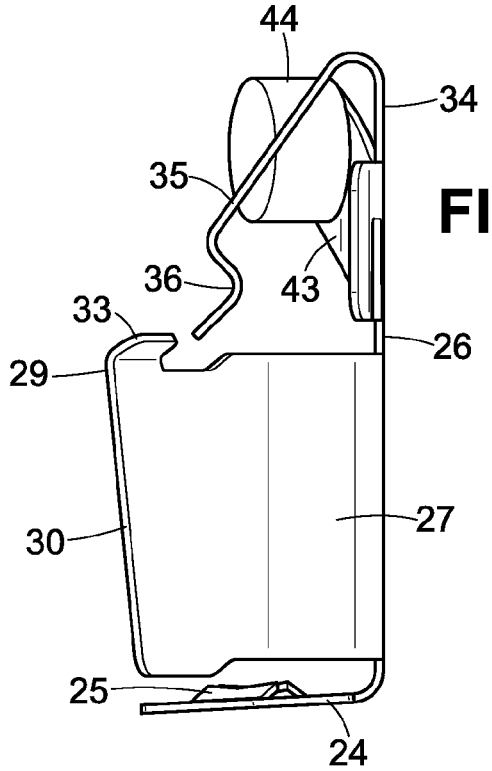

As shown particularly in FIGS. 3 and 5, the spring arms have upwardly divergent outer edges 30. For example, in the illustrated embodiment of the invention the outer edges 30 may be disposed at an angle of about 102 degrees with respect to the horizontal. The arrangement is such that, because of angular disposition of the spring arms, the upper portions of the outer edges 30 are positioned slightly more radially inward, toward the center of the bezel, than lower portions of those edges.

As shown in FIG. 7, the bottom flange 21 of the bezel 14 is provided with an upwardly projecting circular bead 31 extending around the inner edge of the flange. The bead 31 serves to support one or more (typically up to three) circular filter discs 22 in an axial stack. The filter discs 22 are positioned in centered relation in the bezel by means of circumferentially spaced internal ribs 32 extending inward from the circular flange of the bezel 14. The upwardly divergent outer edges 30 of the spring arms are positioned so that the lower portions thereof will be resiliently displaced outwardly when a first disc is inserted into the bezel and supported on the annular bead 31. The displaced spring arms bear inward against outer edges of the disc, and the upwardly divergent outer edges 30 of the spring arms bear somewhat downwardly on upper portions of the disc to retain the disc against the annular bead 31. If a second filter disc is inserted into the bezel, it will be engaged by upper portions of the outer edges 30, which are positioned slightly more inward than the edge portions engaging the lower disc, such that the spring arms will again be displaced in a radially outward direction and will resiliently bear inward and downward upon the uppermost disc. A similar action takes place if a third disc (not shown) is inserted onto the stack, it being understood that the accessory retaining elements 23 are, in the illustrated embodiment, configured to receive a maximum of three standard discs. In each case, downward pressure against the uppermost disc serves to retain the entire disc stack positioned in the bezel 14.

To facilitate displacement of the spring arms 28 during insertion of filter discs 22, the upper corner portions of the spring arms can be provided with outwardly bent tabs 33. These tabs initially engage lower portions of the filter discs 22 during insertion into the bezel and cause the spring arms to be easily displaced outwardly when a disc is pressed downwardly into the bezel.

In the illustrated form of the invention, the vertical support 26 of the multifunctional accessory retaining element 23 has a support portion 34 which extends upward above the spring arms 28 and supports a spring clip 35. The spring clip is integral with the support portion 34 and extends downward and inward therefrom. At its lower end, the spring clip has a V-shaped indentation 36 positioned to receive the edge of a flat, outwardly extending flange 37 of a reflector 38, the body 39 of which is suitably shaped for the service intended.

Figure 9:
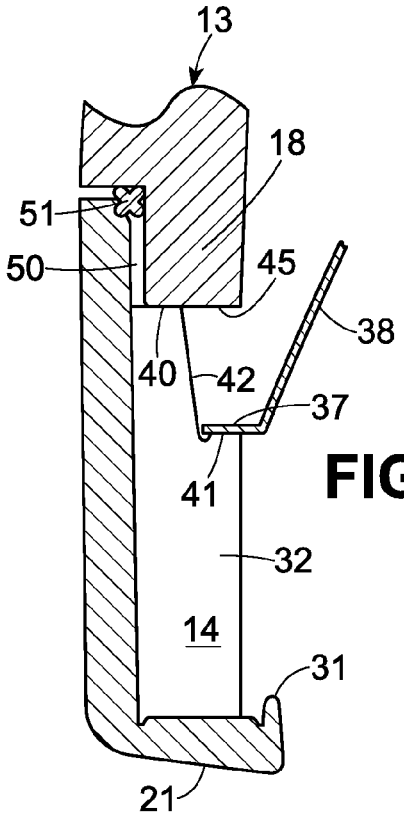
FIG. 9 is an enlarged, fragmentary cross sectional view showing elements of the bezel, housing and reflector in assembled relationship.

As is evident in FIGS. 7 and 9, the internal ribs 32 of the bezel 14 are formed with upper and lower horizontally disposed support surfaces 40, 41. The lower support surfaces 41 serve to position the reflector flange 37 (and thus the reflector 38 itself) accurately and in a stable manner with respect to the bezel 14. The reflector is installed in the bezel by pressing the reflector downward until the flange 37 snaps into the V-shaped indentations 36 of an opposed pair of accessory retaining elements 23. The V-shaped indentations then serve to press the flange resiliently downward against the several support surfaces 41. The reflector is also accurately positioned coaxially with the bezel by the confining surfaces 42 of the internal ribs 32.

Pursuant to another feature of the invention, the accessory retaining elements 23 are each provided with a housing engaging arm 43 integral with the support portion 34 of the vertical support 26 and extending laterally therefrom, spaced closely above the upper edges of the spring arms 28. The arm 43 is curved inward slightly, to follow the arcuate contours of the bezel side wall 19, and mounts an inwardly projecting cylindrical peg 44 at its outer end.

Figure 8:
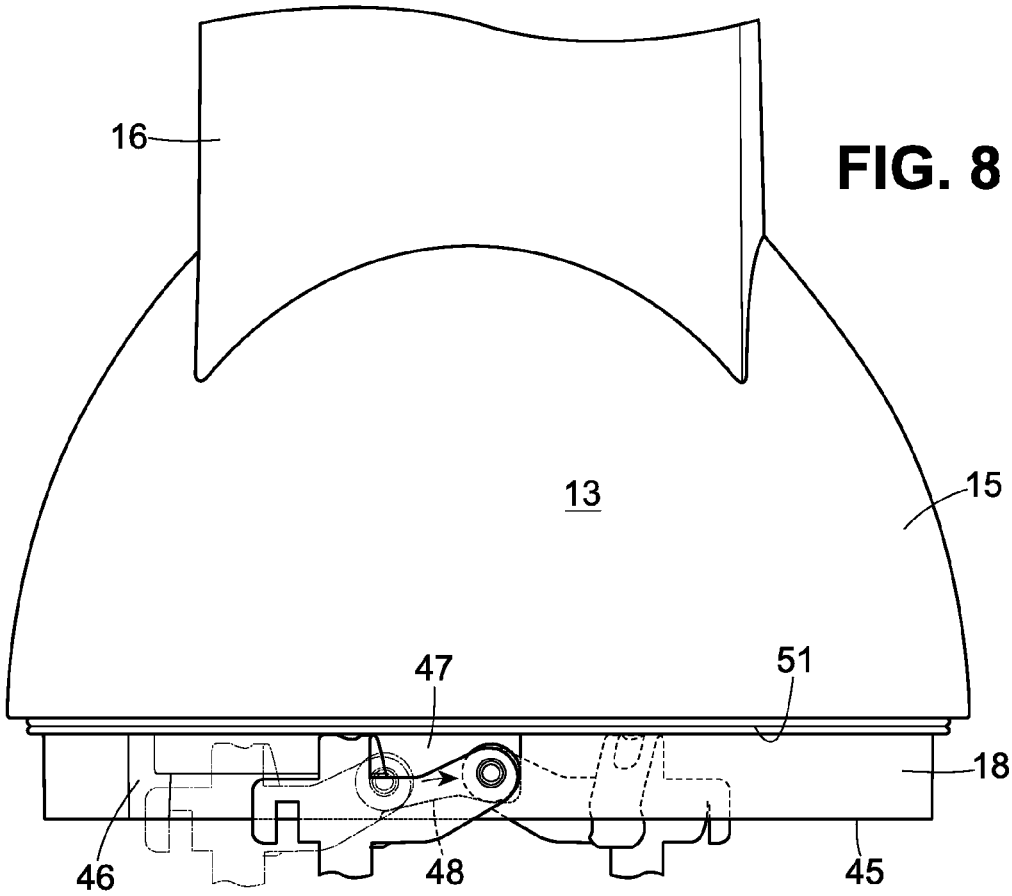
FIG. 8 is a broken away view illustrating the interaction between the multifunctional elements and the lamp housing for securing of the bezel to the housing.

As indicated in FIGS. 2 and 8, the downwardly projecting cylindrical wall 18 of the lamp housing 13 has a bottom surface 45 which, when the bezel 14 if fully assembled to the lamp body, will engage the upper support surfaces of the internal ribs 32 of the bezel (FIG. 9) to accurately position the bezel (and therefore the reflector 38 as well) with respect to the housing 13. Pursuant to one aspect of the invention, the bezel 14 is secured to the housing 13 by means of the arms 43 and pegs 44, which engage elements of the cylindrical wall 18. To this end, the cylindrical wall 18 is formed in diametrically opposed locations with downward and outwardly opening recesses 46 which are of sufficient width (circumferentially) to receive upper portions of the multifunctional accessory retaining elements 23. Communicating with the recesses 46 are adjacent recesses 47 which are outwardly open but closed at the bottom by means of a bottom wall 48.

To initially assemble the bezel 14 with the housing 13, the bezel is rotated to a position in which the multifunctional accessory retaining elements 23 are aligned with the downwardly opening recesses 46, allowing the accessory retaining elements 23 to be inserted into the recesses and the bezel 14 to be applied over the downwardly projecting cylindrical wall 18. Thereafter, the bezel 14 is rotated clockwise (as viewed from below) relative to the housing 13, causing the arms 43 and pegs 44 to enter the open ends of the recesses 47. The pegs 44 are thus engaged and supported by the bottom walls 48 of the recesses 47. As evident in FIGS. 2 and 8, the bottom walls 48 are contoured such that, as the pegs 44 advance in a clockwise direction, they are first displaced upwardly and then allowed to drop downwardly slightly and captured with a detent action at the closed ends of the recesses 47. The natural spring characteristics of the arms 48 allows the pegs to be moved through the detent position after the surface 45 has engaged the support surfaces 40 (FIG. 9), such that the bezel is effectively locked in accurately positioned relation to the lamp housing 13. To advantage, a stop element 49 (FIG. 2) can be provided on the cylindrical projection, to engage with one of the internal ribs 32 of the bezel and limit the rotation of the bezel in the clockwise direction. The bezel can be readily removed, when desired, by a counterclockwise twisting motion to overcome the detent action and allow the pegs 44 to be withdrawn circumferentially from the recesses 47.

In the illustrated embodiment, the internal ribs 32 have thin portions 50 extending upward from the upper support surfaces, between the cylindrical wall 18 and the bezel wall 19 to accurately position the bezel axially with respect to the housing while minimizing frictional resistance between the bezel and housing during mounting and removal of the bezel. Desirably, the interior of the lamp housing may be sealed with a Quad Ring 51 or the like to keep it free of dust.

The lighting fixture of the invention greatly facilitates rearrangement of the working elements, including the filters and the reflector, as is necessary or desirable from time to time to change the character of the lighting. When such changes are desired, a quick partial rotation of the bezel 14 enables it to be completely separated from the main housing 13, and along with it, as a unit, the filters and the reflector. In this respect, it is often desirable to change the reflector to provide a different focus of the light beam. Both the reflector 38 and the filter discs 22 are easily removed by separating them from between the two multifunctional accessory retaining elements 23, which both retain and position them by an advantageous spring action. While different reflectors can be easily snapped into place in the accessory retaining elements 23, they are precisely positioned laterally by the confining surfaces 42 and axially by the support surfaces 41 on the bezel. In the preferred embodiment of the fixture, the lamp 17 has a cylindrical body. The precise positioning of the reflector in the bezel enables the reflector opening 52 fit around the lamp with an absolute minimum of clearance space, thus maximizing the efficiency of the reflected light.

The new fixture provides a number of advantageous features with respect to facilitating the periodic revision of lighting characteristics while providing a unit of low cost and minimal complication. All of the normally changeable elements (i.e., the reflector and filters) are held in the bezel and are easily removable and mountable with a simple twist action of the bezel. This is in made possible in large part by the use of unique and novel multifunctional accessory retaining elements which position and secure filters in various numbers, provide for easy but precise mounting of the reflector, and provide quick but positive and precise assembly of the bezel to the lamp housing. The multifunctional clip elements 23 are inexpensively made of sheet metal material, which shaped and formed in a novel manner to facilitate the initial mounting in the bezel and to obtain the desired multiple functions from the elements after mounting.

Mounting of the reflector in the removable bezel also makes the lamp 17 easily accessible and facilitates replacement of the lamp when necessary.

It should be understood, of course, that the specific form of the invention herein illustrated and described in intended to be illustrative only as many variations may be made thereto within the clear teachings and scope of the invention. Reference should therefore be made to the following claims in ascertaining the full and true scope of the invention.

What is claimed is:

1. In a specialized lighting fixture of the type comprising a lamp housing having a housing axis and an open end, a lamp mounted in said housing generally on said housing axis and exposed to said open end, a reflector associated with said lamp and said housing for directing light from said lamp toward said open end, and an annular bezel having a bezel axis and being removably mounted to said lamp housing at the open end thereof with said housing axis and said bezel axis in substantially coincident alignment, the improvement characterized by (a) said bezel comprising a side wall of circular form and an annular front flange extending radially inward from said side wall and defining a front opening, (b) a plurality of multifunctional, resilient accessory-retaining elements mounted in spaced apart relation on an inside of said bezel, (c) said accessory retaining elements each including an opposed pair of laterally extending spring arms angled inwardly relative to said bezel axis and having opposite side edges extending upwardly and laterally such that upper portions of said side edges are positioned closer to said bezel axis than lower portions of said side edges, (d) said side edges being engageable with peripheral outer edges of a circular accessory element to position said accessory element within said bezel and to urge said accessory element toward said front flange, (e) said resilient accessory retaining elements further including upwardly extending spring elements projecting above said laterally extending spring arms and resiliently engageable with lower portions of said reflector to removably mount said reflector on said bezel, (f) said reflector having a generally open front end and a generally closed back end and having a central lamp-receiving opening in said back end, (g) said lamp being of elongated generally cylindrical configuration and being aligned with said housing axis, (h) said lamp-receiving opening being arranged to closely surround back portions of said lamp when said bezel is mounted on said housing.

2. A lighting fixture according to claim 1, wherein the side edges of said accessory-retaining elements extend upward for a distance greater than a thickness dimension of a circular accessory element to be engaged thereby, whereby said side edges engage peripheral outer edges of at least an uppermost one of an axial stack of two or more such circular accessory elements.

3. A lighting fixture according to claim 1, wherein (a) said accessory-retaining elements are formed of spring metal and comprises a base member secured to the flange of said bezel, (b) a first spring element extends upwardly from said base member and mounts, on opposite sides of a lower portion thereof, said laterally extending spring arms, and (c) an upper portion of said first spring element forms a reflector engaging element which is resiliently engageable with an edge portion of said reflector to position and mount said reflector.

4. A lighting fixture according to claim 1, wherein (a) said housing is formed with a lower portion received in close fitting relation to an upper portion of said bezel side wall, (b) said housing lower portion is formed with a plurality of recesses therein, positioned in predetermined alignment with said accessory retaining elements, (c) said accessory retaining elements being provided with a spring element mounting a recess-engaging peg, and (d) said pegs are engaged in said recesses upon rotation of said bezel with respect to said housing for securing said bezel in position.

5. A lighting fixture according to claim 4, wherein said recesses are formed with bottom contours including upwardly inclined surfaces for displacing said pegs upwardly upon rotation of said bezel, and retaining portions positioned below uppermost levels of said inclined surfaces for releasably retaining said pegs and said bezel in assembled relation with said housing.

6. A lighting fixture according to claim 5, wherein (a) the spring elements mounting said recess-engaging pegs extend laterally from the upwardly extending spring elements at a level above said laterally extending spring arms.

7. A lighting fixture according to claim 4, wherein
(a) upper portions of said bezel side wall surround the close-fitting lower portion of said housing,
(b) said recesses in said housing lower portion face radially outward, and
(c) said pegs project inward from the spring elements mounting them for engagement with said outwardly facing recesses.

8. A lighting fixture according to claim 7, wherein
(a) said housing lower portion is formed with downwardly opening recesses communicating with and extending circumferentially from said outwardly facing recesses to accommodate upward movement of said bezel and said pegs for initial assembly of said bezel with said housing.

9. A lighting fixture according to claim 8, wherein
(a) said housing and said bezel have mutually facing surfaces positioned in closely spaced relation when said bezel is fully installed on said housing, and
(b) a resilient sealing ring is positioned between said mutually facing surfaces.

10. A lighting fixture according to claim 1, wherein
(a) a pair of said resilient accessory retaining elements are mounted in diametrically opposed relation to said bezel and engage said reflector in two diametrically opposed regions, and
(b) said bezel is formed with one or more upwardly facing support surfaces, on an inside of said side wall and spaced above said annular front flange, engageable with lower edge portions of said reflector, when said reflector is engaged by said accessory retaining elements to accurately position said reflector with respect to said lamp housing.

11. A lighting fixture according to claim 10, wherein
(a) said bezel is formed with a plurality in circumferentially spaced inwardly projecting ribs forming said upwardly facing support surfaces,
(b) outer portions of said reflector engage inner surface portions of said ribs, above said support surfaces, for positioning said reflector coaxially with respect to said bezel axis.

12. A lighting fixture according to claim 11, wherein
(a) said reflector is formed with a radially outwardly extending flange at said lower edge portions thereof,
(b) bottom surface portions of said flange are engaged by and supported on said support surfaces, and
(c) outer edges of said flange engage said inner surface portions of said ribs.

13. A lighting fixture according to claim 12, wherein
(a) said ribs are formed with a step defining said upwardly facing support surfaces, engaging bottom surface portions of said reflector flange, and with upwardly extending, inwardly facing surfaces engaging outer edges of said reflector flange to co-axially position said reflector.

14. A lighting fixture according to claim 13, wherein said upwardly extending, inwardly facing surfaces are upwardly divergent to facilitate initial alignment of said reflector.

15. In a specialized lighting fixture of the type comprising a lamp housing having a housing axis and an open end, a lamp mounted in said housing generally on said housing axis and exposed to said open end, a reflector associated with said lamp and said housing for directing light from said lamp toward said open end, and an annular bezel having a bezel axis and being removably mounted to said lamp housing at the open end thereof with said housing axis and said bezel axis in substantially coincident alignment, the improvement characterized by
(a) said bezel comprising a side wall of circular form and an annular front flange extending radially inward from said side wall and defining a front opening,
(b) a plurality of, multifunctional resilient elements mounted in spaced apart relation on an inside of said bezel and mounting accessory lenses and said reflector in said bezel,
(c) said multifunctional elements including upwardly extending spring elements resiliently engageable with lower portions of said reflector and laterally extending elements engageable with accessory elements, to removably mount said reflector and said accessory elements on said bezel,
(d) said reflector having a generally open front end and a generally closed back end and having a central lamp-receiving opening in said back end,
(e) said lamp being of generally cylindrical configuration and being aligned with said housing axis,
(f) said lamp-receiving opening being of a size to closely surround back portions of said lamp when said bezel is mounted on said housing,
(g) said bezel having support surfaces engageable with lower portions of said reflector when said reflector is engaged by said spring elements to hold said reflector in alignment with said axes, and
(h) interacting elements on said multifunctional elements and said housing for securing said bezel to said housing upon rotational movement of the bezel with respect to the housing.

16. A lighting fixture according to claim 15, wherein said interacting elements on said bezel and said housing comprise
(a) a plurality of open sided recesses in said housing adjacent the open end thereof,
(b) said open sided recesses being connected to adjoining recesses open at the bottom and side,
(c) said open sided recesses having contoured bottom surfaces including upwardly inclined surface portions and retaining portions adjacent to said upwardly inclined surface portions,
(d) said multifunctional elements including laterally extending spring arms and recess-engaging elements mounted at the ends of said spring arms, and
(e) said contoured bottom surfaces being operative, upon rotational displacement of said bezel with respect to said housing, to displace said recess-engaging elements upwardly relative to said housing, and to releasably retain said bezel in a rotationally displaced position.

17. A lighting fixture according to claim 16, wherein
(a) said accessory engaging spring elements comprise an opposed pair of laterally extending spring arms angled inwardly relative to said bezel axis and having opposite side edges extending upwardly and laterally such that upper portions of said side edges are positioned closer to said bezel axis than lower portions of said side edges,
(b) a plurality of circular accessory elements are selectively useable with said lighting fixture and positionable in axially stacked relation within said bezel, and
(c) outer edge portions of an uppermost one of said accessory elements are engaged by said opposite side edges of said laterally extending spring arms to retain said accessory elements in said bezel.

* * * * *

UNITED STATES PATENT AND TRADEMARK OFFICE

CERTIFICATE OF CORRECTION

PATENT NO. : 8,118,455 B2
APPLICATION NO. : 12/610847
DATED : February 21, 2012
INVENTOR(S) : David M. Cowan et al.

It is certified that error appears in the above-identified patent and that said Letters Patent is hereby corrected as shown below:

On the Title Page,

Item (73) Assignee should read: Lighting Services, Inc., Stony Point, NY (US)

Signed and Sealed this
Eighth Day of April, 2014

Michelle K. Lee

Michelle K. Lee
*Deputy Director of the United States Patent and Trademark Office*